US011135523B2

(12) United States Patent
Gamble et al.

(10) Patent No.: US 11,135,523 B2
(45) Date of Patent: Oct. 5, 2021

(54) TOY VEHICLE WITH SELECTED CENTRE OF GRAVITY

(71) Applicants: Spin Master Ltd., Toronto (CA); Bbx Design Group Inc, Humarock, MA (US)

(72) Inventors: Lee Gamble, Etobicoke (CA); Chaitanya Dogra, Oakville (CA); Jason C. Lee, Humarock, MA (US)

(73) Assignee: Spin Master Ltd., Toronto (CA)

( * ) Notice: Subject to any disclaimer, the term of this patent is extended or adjusted under 35 U.S.C. 154(b) by 0 days.

(21) Appl. No.: 16/723,986

(22) Filed: Dec. 20, 2019

(65) Prior Publication Data

US 2021/0187404 A1 Jun. 24, 2021

(51) Int. Cl.

| | |
|---|---|
| ***A63H 13/18*** | (2006.01) |
| ***A63H 15/06*** | (2006.01) |
| ***A63H 17/00*** | (2006.01) |
| ***A63H 17/26*** | (2006.01) |
| ***A63H 30/04*** | (2006.01) |

(52) U.S. Cl.
CPC ..... *A63H 17/004* (2013.01); *A63H 17/262* (2013.01); *A63H 30/04* (2013.01)

(58) Field of Classification Search
CPC ..... A63H 17/004; A63H 17/262; A63H 30/04
See application file for complete search history.

(56) References Cited

U.S. PATENT DOCUMENTS 3,000,137 A * 9/1961 Vine ..... A63H 17/02 446/6
3,816,958 A * 6/1974 Winston ..... A63H 29/20 446/462

(Continued)

FOREIGN PATENT DOCUMENTS

CN 303692532 S 6/2016
CN 303692533 S 6/2016

(Continued)

OTHER PUBLICATIONS

Railey72, 'Paddle Tires and Dyable Wheels'. TamiyaClub, Jan. 6, 2008. Photograph retrieved from TamiyaClub online community [online], [retrieved on Jun. 27, 2019]. Retrieved from the Internet: <URL: https://www.tamiyaclub.com/showroom_model.asp?cid=69701&id=2467>.

(Continued)

*Primary Examiner* — Eugene L Kim
*Assistant Examiner* — Matthew B Stanczak
(74) *Attorney, Agent, or Firm* — Millman IP Inc.

(57) ABSTRACT

In one aspect, there is provided a toy vehicle that includes a vehicle body, at least one motor and a plurality of wheels. The at least one motor is mounted to the vehicle body, and is sized to have a selected amount of torque. The plurality of wheels includes at least one driven wheel which includes at least one flip-over wheel which has an axis closer to one end of the vehicle than the other end. In an upright orientation the vehicle body extends above the plurality of wheels. The toy vehicle has a centre of gravity that is positioned, such that, application of torque from the at least one motor causes the vehicle body to drive rotation of the vehicle body about the axis of rotation from an inverted orientation over to the upright orientation.

7 Claims, 8 Drawing Sheets

(56) References Cited

U.S. PATENT DOCUMENTS 4,363,187 A * 12/1982 Shinohara ..... A63H 17/004 446/437
4,488,375 A * 12/1984 Cheng ..... A63H 17/40 446/437
D281,000 S 10/1985 Kuna et al.
4,591,346 A * 5/1986 Ikeda ..... A63H 17/004 446/437
4,894,042 A * 1/1990 Kamikawa ..... A63H 17/004 446/437
5,019,009 A * 5/1991 Chao-Chin ..... A63H 17/004 446/437
5,259,808 A * 11/1993 Garr ..... A63H 17/004 446/437
5,667,420 A * 9/1997 Menow ..... A63H 17/004 180/22
5,722,872 A * 3/1998 Simmons ..... A63H 17/262 280/43.23
5,919,075 A * 7/1999 George ..... A63H 17/004 446/437
6,015,330 A * 1/2000 Simmons ..... A63H 17/004 446/431
6,024,627 A * 2/2000 Tilbor ..... A63H 17/004 446/233
6,095,890 A * 8/2000 George ..... A63H 17/004 446/437
6,129,607 A * 10/2000 Hoeting ..... A63H 17/004 446/396
6,227,934 B1 * 5/2001 Isaksson ..... A63H 17/004 446/437
6,764,374 B2 * 7/2004 Tilbor ..... A63H 17/262 446/233
8,900,031 B2 * 12/2014 Benedict ..... A63H 17/36 446/437
8,939,812 B2 1/2015 Chan et al.
9,283,489 B2 * 3/2016 Pischiera ..... B62D 49/08
9,352,242 B2 * 5/2016 Rehkemper ..... A63H 17/26
9,573,072 B2 * 2/2017 Cai ..... A63H 17/02
9,789,413 B2 * 10/2017 Erhart ..... A63H 17/262
9,931,580 B2 * 4/2018 Rehkemper ..... A63H 17/008
2001/0044255 A1 * 11/2001 Lee ..... A63H 17/004 446/469
2002/0137428 A1 9/2002 Tilbor et al.
2004/0082268 A1 * 4/2004 Choi ..... A63H 30/04 446/454
2005/0112987 A1 * 5/2005 Chan ..... A63H 17/262 446/93
2005/0148282 A1 * 7/2005 Moll ..... A63H 29/22 446/456
2008/0261487 A1 * 10/2008 Torres ..... A63H 17/262 446/448
2008/0268744 A1 * 10/2008 Jones ..... A63H 17/262 446/462
2009/0088046 A1 * 4/2009 Discoe ..... A63H 23/10 446/465
2009/0149113 A1 * 6/2009 Lund ..... A63H 17/004 446/454
2009/0203292 A1 * 8/2009 Clark, Jr. ..... A63H 17/26 446/454
2011/0054717 A1 3/2011 Yamauchi et al.
2013/0252510 A1 * 9/2013 Wallace ..... A63H 17/262 446/465
2015/0137497 A1 * 5/2015 Pischiera ..... A63H 17/00 280/755
2016/0129355 A1 * 5/2016 Erhart ..... A63H 17/40 446/456
2019/0233035 A1 8/2019 Meager
2019/0351345 A1 * 11/2019 Bloomfield ..... A63H 17/26

FOREIGN PATENT DOCUMENTS

CN 304817527 S 9/2018
WO 01/72391 A1 10/2001
WO 2019/005727 A 1/2019

OTHER PUBLICATIONS

Screen captures from YouTube video clip entitled "New 3D Printed RC Car Tires—Driving on Water!!!," 2 pages, uploaded on Oct. 1, 2017 by user RCLifeOn. Retrieved from Internet: <https://www.youtube.com/watch?v=YWZkXu0QfAo>.

Hobbysoul 4pc RC 1/8 Paddles Buggy Tires Hex 17mm Wheels For Snow Sand Master Off Road Car. Photograph retrieved from Amazon.com product page [online], [retrieved on Jun. 27, 2019], Retrieved from the Internet: <URL https://www.amazon.com/hobbysoul-Paddles-Buggy-Wheels-Master/dp/B076NPQ41S>.

Pro-Line Sling Shot 3.8 (Traxxas Style Bead) Sand Tires Mounted (2) PL1179-11. Photograph retrieved from EURO RC product page [online], [retrieved on Jun. 27, 2019]. Retrieved from the Internet: <URL: https://www.eurorc.com/product/12376/pro-line-sling-shot-38-traxxas-style-bead-sand-tires-mounted-2>.

RC Car 1/8 17mm Hex Hub Baja Buggy Snow Sand Paddle Tires Tyre and Wheels 82-807. Photograph retrieved from AliExpress product page [online], [retrieved on Jun. 27, 2019], Retrieved from the Internet <URL: https://www.aliexpress.com/item/32824988993.html>.

Traxxas X-MAXX Paddle Wheels That Give You the Ability to Go Across Water with Your Truck. Everyone Has Seen The Video and These Tires and Wheels are What Make It Happen. Photograph retrieved from Amazon.com product page [online], [originally retrieved on Jun. 27, 2019], Retrieved from the Internet: https://www.amazon.com/Traxxas-4175-Stampede-Pre-Glued-Mounted/dp/B0714MXG4G/ref=sr_1_5?dchild=1&keywords=traxxas+paddle+wheel+water&qid=1627578315&sr=8-5.

Yiguo 4pcs 1 8 Scale RC Off Road Baja Buggy Snow Sand Paddle Tires Tyre and Wheels for HSP HPI . Photograph retrieved from Amazon.com product page [online], [retrieved on Jun. 27, 2019]. Retrieved from the Internet: <https://www.amazon.com/Yiguo-Scale-Paddle-Tires-Wheels/dp/B01FNUTO3K>.

* cited by examiner

TOY VEHICLE WITH SELECTED CENTRE OF GRAVITY

FIELD

The specification relates generally to toy vehicles. In particular, the following relates to toy vehicles that can return to an upright state from an inverted state.

BACKGROUND OF THE DISCLOSURE

During play with toy vehicles, it is possible for the vehicle to wind up in an inverted orientation (i.e. upside down). It is inconvenient for the user, especially when the toy vehicle is operated by a user using a remote control, to have to go over to the vehicle and right the vehicle for continued play. It is known to provide toy vehicles that have vehicle bodies and large wheels such that the vehicles are capable of being driven while upside down. However, these vehicles generally do not resemble real-world vehicles, thereby detracting from the play value of these vehicles in some instances. It would be advantageous to provide a vehicle that is capable of righting itself from an inverted orientation. It would be particularly advantageous to be able to carry this out without increasing the cost or complexity of the toy vehicle unnecessarily.

SUMMARY OF THE DISCLOSURE

In one aspect, there is provided a toy vehicle that includes a vehicle body, at least one motor and a plurality of wheels. The at least one motor is mounted to the vehicle body, and is sized to have a selected amount of torque. The plurality of wheels are rotatably mounted to the vehicle body. The plurality of wheels includes at least one driven wheel that is drivable by the at least one motor. The at least one driven wheel includes at least one flip-over wheel. The toy vehicle has a first end and a second end. The at least one flip-over wheel has an axis of rotation that is closer to the first end than to the second end. The toy vehicle has an upright orientation in which the plurality of wheels support the vehicle body above a support surface, and in which the vehicle body extends above the plurality of wheels, and an inverted orientation in which the vehicle body at least in part supports the toy vehicle on the support surface. The toy vehicle has a centre of gravity that is positioned, such that, application of the selected amount of torque from the at least one motor to the at least one driven wheel causes a reaction torque in the vehicle body to drive rotation of the vehicle body about the axis of rotation from the inverted orientation over to the upright orientation on the support surface.

Other technical advantages may become readily apparent to one of ordinary skill in the art after review of the following figures and description.

BRIEF DESCRIPTIONS OF THE DRAWINGS

For a better understanding of the embodiment(s) described herein and to show more clearly how the embodiment(s) may be carried into effect, reference will now be made, by way of example only, to the accompanying drawings in which.

Figure 1A:
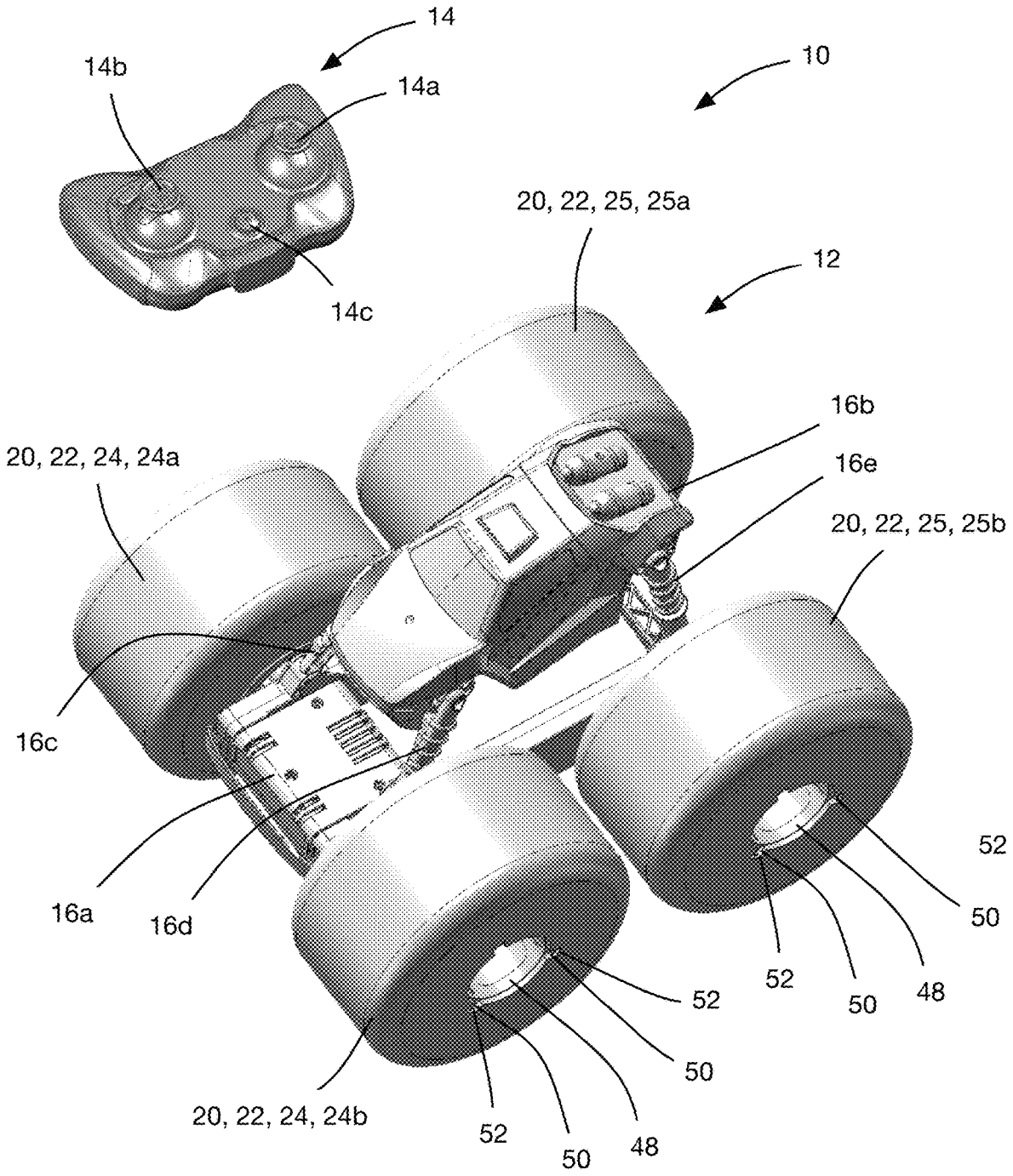
FIG. 1A is a perspective view of a toy vehicle arrangement in accordance with an embodiment of the present disclosure, including a toy vehicle and a remote control.

Unless otherwise specifically noted, articles depicted in the drawings are not necessarily drawn to scale.

DETAILED DESCRIPTION

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Figure 1B:
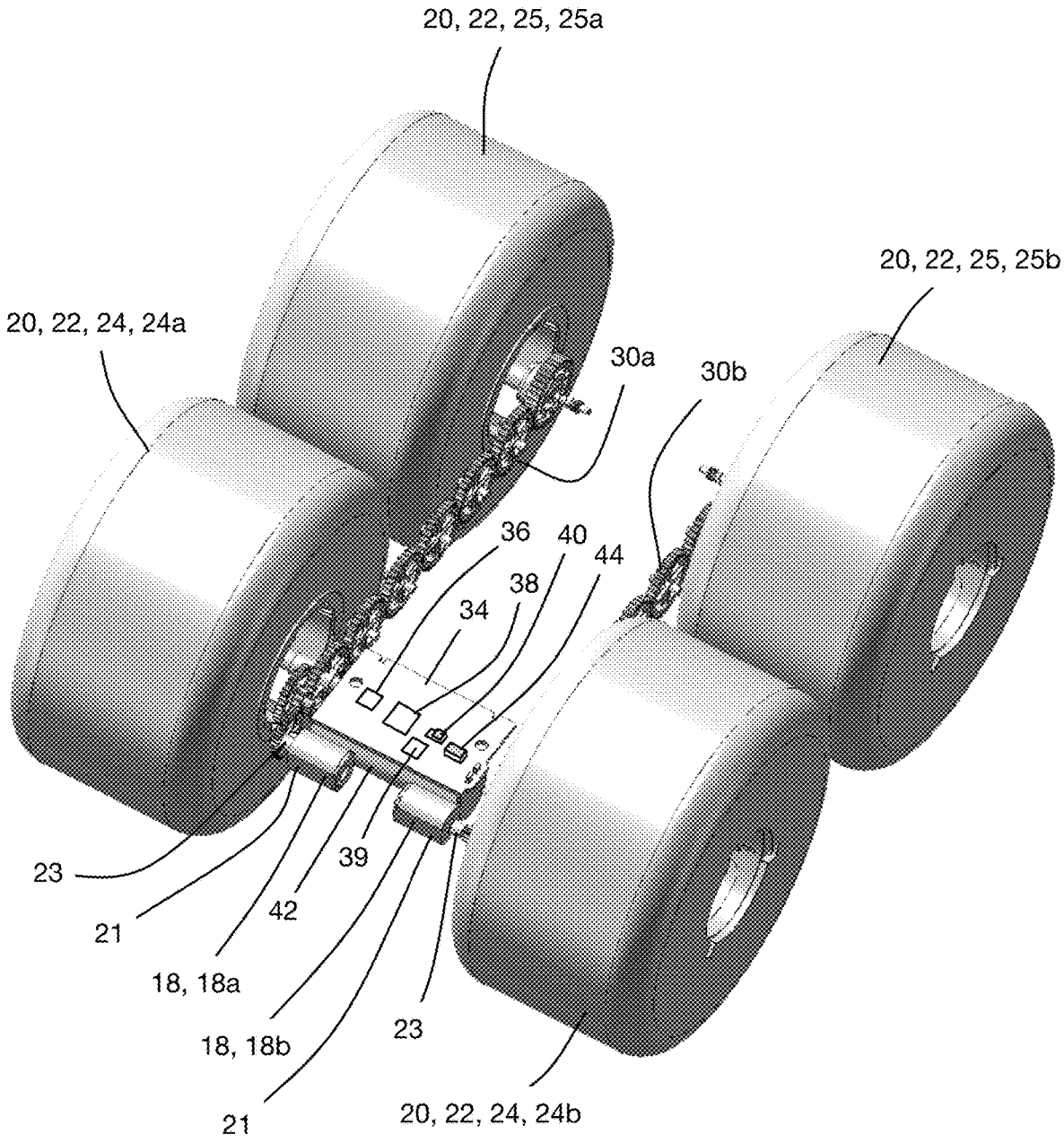
FIG. 1B is a perspective view of a drive train and a control system from the toy vehicle shown in FIG. 1A.

Reference is made to FIGS. 1A and 1B, which shows a toy vehicle arrangement 10 in accordance with an embodiment of the present disclosure. The toy vehicle arrangement 10 includes a toy vehicle 12 and a remote control unit 14. In some embodiments, the remote control 14 may be omitted. The toy vehicle 12 includes a vehicle body 16 (FIG. 1A), at least one motor 18 (FIG. 1B), and a plurality of wheels 20.

In the example shown in FIG. 1A, the vehicle body 16 includes a lower body portion 16*a*, an upper body portion 16*b*, and a plurality of struts 16*c*, 16*d*, 16*e* and 16*f* (shown in FIG. 2) that support the upper body portion 16*b* above the lower body portion 16*a*.

The at least one motor 18 in the present example includes a first motor 18*a* and a second motor 18*b*. The first and second motors 18*a* and 18*b* each have a motor housing 21 that is mounted to the vehicle body 16 and a motor output shaft 23 and are sized to have a selected amount of torque.

The plurality of wheels 20 are rotatably mounted to the vehicle body 16. The plurality of wheels includes at least one driven wheel 22 that is drivable by the at least one motor 18. In the present example, all of the wheels 20 are driven wheels 22. The at least one driven wheel 22 includes at least one flip-over wheel 24. In the example shown, there are first and second flip-over wheels 24, shown individually at 24*a* and 24*b*, respectively. In the present example, the at least one driven wheel 22 further includes at least one non-flip-over wheel 25, which, in the present example, includes first and second non-flip-over wheels 25 and 25*b*, respectively. The at least one flip-over wheel 24 is used to flip the toy vehicle 12 over from an inverted orientation to an upright orientation, as is described further below. The at least one non-flip-over wheel 25, in embodiments in which they are present, is not involved in flipping the toy vehicle 12 over from the invented orientation to the upright orientation.

The toy vehicle 12 has a first end 26 and a second end 28, and has a length L between the first and second ends 26 and 28. In the present example, the first end 26 is the front end and the second end 28 is the rear end, however, it will be understood that the first end 26 could alternatively be the rear end and the second end 28 could be the front end. The at least one flip-over wheel 24 has an axis of rotation A that is closer to the first end 26 than to the second end 28.

As shown in FIG. 1B, the first motor 18*a* is operatively connected to two of the driven wheels 22, namely the first flip-over wheel 24*a*, and to the first non-flip-over wheel 25*a*, via a first torque transfer structure 30*a*, which is a gear train in the embodiment shown. Similarly, the second motor 18*b* is operatively connected to two of the driven wheels 22, namely the second flip-over wheel 24*b*, and to the second non-flip-over wheel 25*b*, via a second torque transfer structure 30*b*, which is also a gear train in the embodiment shown. Alternatively, any other suitable torque transfer structure may be provided.

A control system is shown at 32 in FIG. 1B. The control system 32 controls the operation of the at least one motor 16. The control system 32 in the present example includes a printed circuit board 34 which has a processor 36, a memory 38, an RF communications chip 39, an on-off switch 40, a battery 42, and a charging port 44 connected thereto. The processor 36 carries out instructions which are stored in the memory 38. Some of the instructions may be based on signals that are received from the remote control 14 via the RF communications chip 39. Put another way, the remote control 14 is operable remotely from the toy vehicle 12 to transmit signals to the toy vehicle 12 for use by the control system 32 to control operation of the at least one motor 18, which relate to the aforementioned instructions. The instructions may include, for example:

- an instruction to rotate the motors 18*a* and 18*b* in a forward direction with an amount of torque that varies based on how far the user moves a drive lever 46 forward on the remote control 14;
- an instruction to rotate the motors 18*a* and 18*b* in a backward direction with an amount of torque that varies based on how far the user moves a drive lever 46 backward on the remote control 14;
- an instruction to rotate the first motor 18*a* in a forward direction and the second motor 18*b* in a backward direction each with an amount of torque that varies based on how far the user moves a turn lever 46 to the left on the remote control 14; and
- an instruction to rotate the first motor 18*a* in a backward direction and the second motor 18*b* in a forward direction each with an amount of torque that varies based on how far the user moves a turn lever 46 to the right on the remote control 14.

Other instructions may additionally or alternatively be stored in the memory 38 and may be executed by the processor 36.

Referring to FIG. 1A, the remote control 14 may be equipped with the following controls to enable the user to send the above noted signals to the toy vehicle: a forward/reverse lever 14*a*, a left/right steering lever 14*b*, and an on/off switch 14*c*. A suitable control system may be provided in the remote control, powered by a suitable power source may be provided, as will be understood by one skilled in the art.

The battery 42 is used to provide power to the motors 18. The power transmitted to the motors 18 may be based on the instructions being carried out by the processor 36. The battery 42 may be a rechargeable battery, which is charged using the charging port 44. Alternatively, if the battery 42 is a non-rechargeable battery, the charging port 44 may be omitted. The on-off switch 40, in the present example, physically controls an electrical connection between the battery 42 and the other components of the control system 32 apart from the charging port 44.

The toy vehicle 12 has an upright orientation (FIG. 2) in which the plurality of wheels 20 support the vehicle body 16 above a support surface shown at S, which may be a tabletop, or any other suitable support surface.

Figure 2:
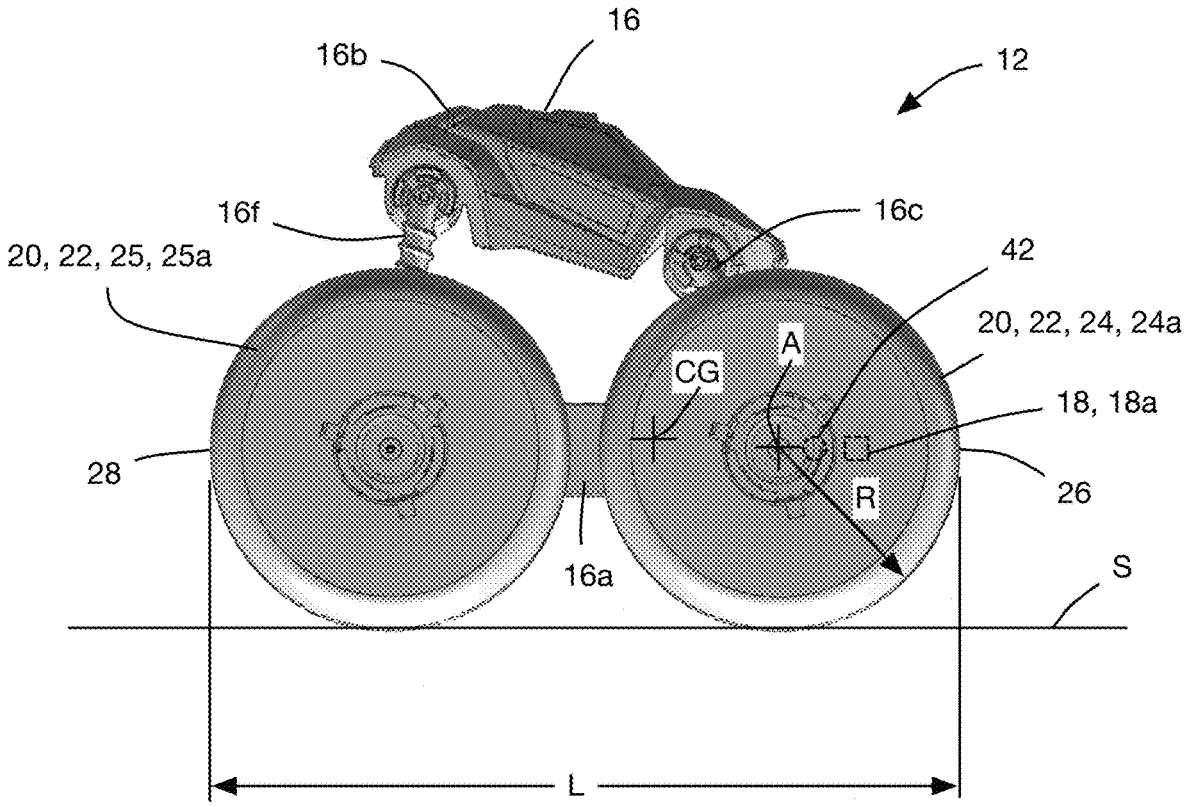
FIG. 2 is a side elevation view of the toy vehicle shown in FIG. 1A.
Figure 3A:
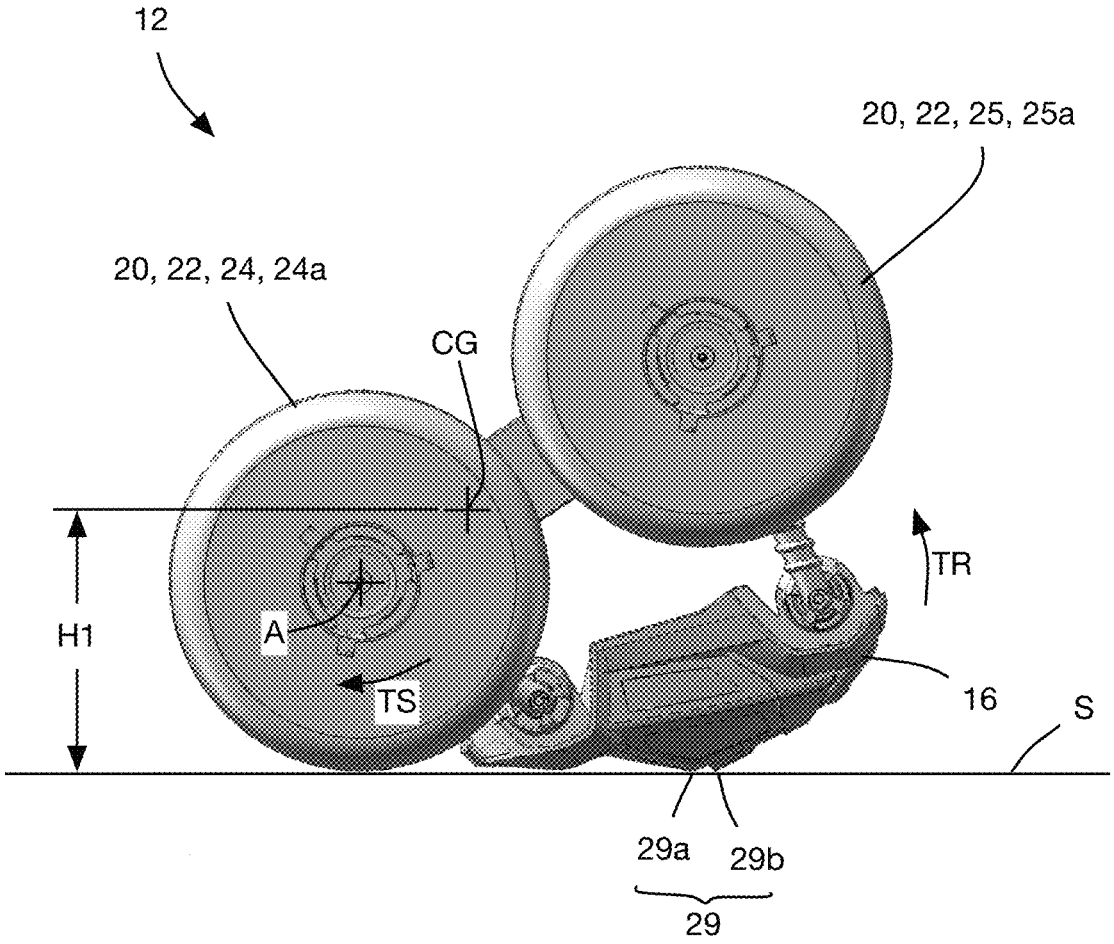
FIGS. 3A-3D are side elevation views that illustrate a progression from an inverted orientation to the upright orientation of the toy vehicle shown in FIG. 2.

As can be seen clearly in FIG. 2, the vehicle body 16 extends above the plurality of wheels 20 when in the upright orientation. This lends some measure of realism to the toy vehicle 12, in the sense that typical vehicles, even monster trucks which have large wheels relative to the size of the vehicle body, have a vehicle body that extends above the wheels. During use, it is possible that the toy vehicle 12 may flip over to an inverted orientation, shown in FIG. 3A. In the inverted orientation the vehicle body 16 at least in part supports the toy vehicle 12 on the support surface S. Put another way, the vehicle body 16 has a balance surface arrangement 29 that at least partially supports the toy vehicle 12 on the support surface S when the toy vehicle 12 is in the inverted orientation. The balance surface arrangement 29 may include a plurality of surface portions, such as are shown at 29*a* and 29*b* in FIG. 3A. The balance surface arrangement 29 in FIG. 3A only in-part supports the toy vehicle 12 on the support surface S when the toy vehicle 12 is in the inverted orientation, while the at least one flip-over wheel 24 also in-part supports the toy vehicle 12 on the support surface S when the toy vehicle 12 is in the inverted orientation.

In order to permit the user to flip the toy vehicle 12 back over to the upright orientation from the inverted orientation, the toy vehicle has a centre of gravity CG that is positioned at a selected position. More specifically, the toy vehicle 12 has the centre of gravity CG positioned, such that, application of the selected amount of torque (shown at TS in FIG. 3A) from the at least one motor 18 to the at least one driven wheel 22 causes a reaction torque (shown at TR in FIG. 3A) in the motor housing 21 and therefore in the vehicle body 16 to drive rotation of the vehicle body 16 about the axis of rotation A from the inverted orientation (FIG. 3A) over to the upright orientation (FIG. 2) on the support surface S. The selected torque that the at least one motor 18 is driven with is dependent on many factors including the losses that occur between the at least one motor 18 and the at least one flip-over wheel 24, the position of the centre of gravity CG of the toy vehicle 12, the weight of the toy vehicle 12, and the radius of the at least one flip-over wheel 24. One skilled in the art will be able to determine a suitable selected torque for the at least one motor based on the specifics of a given application.

Figure 3B:
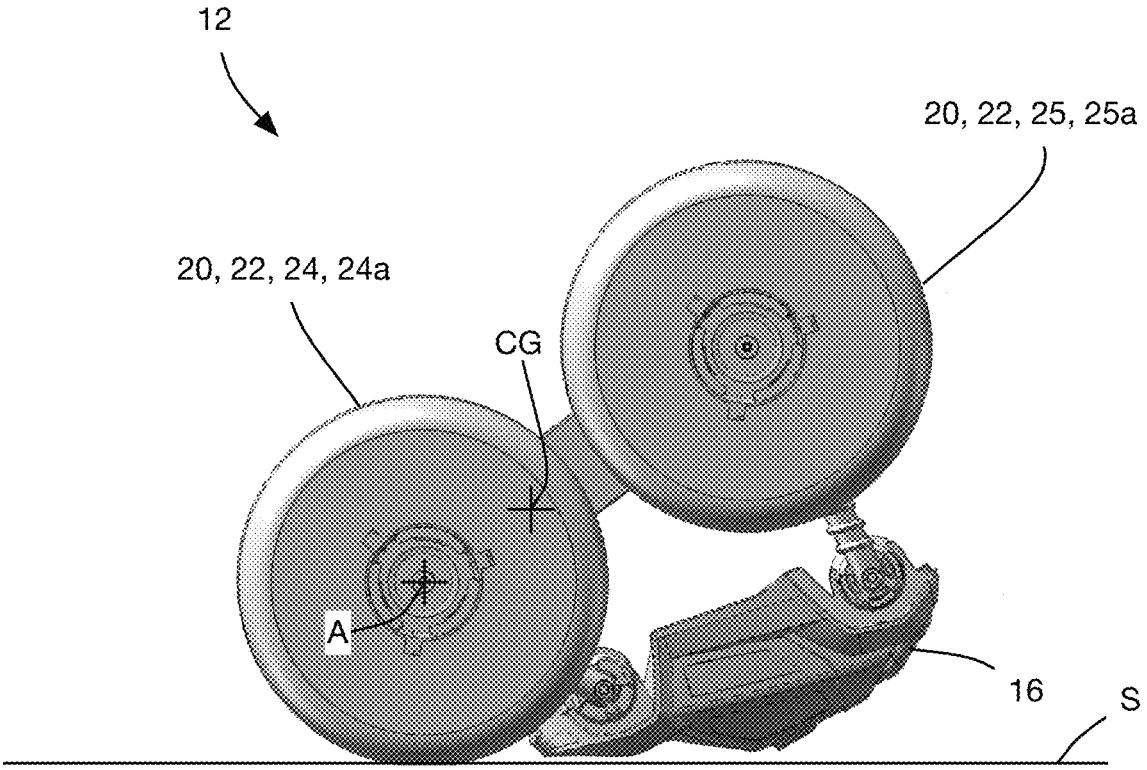
Figure 3C:
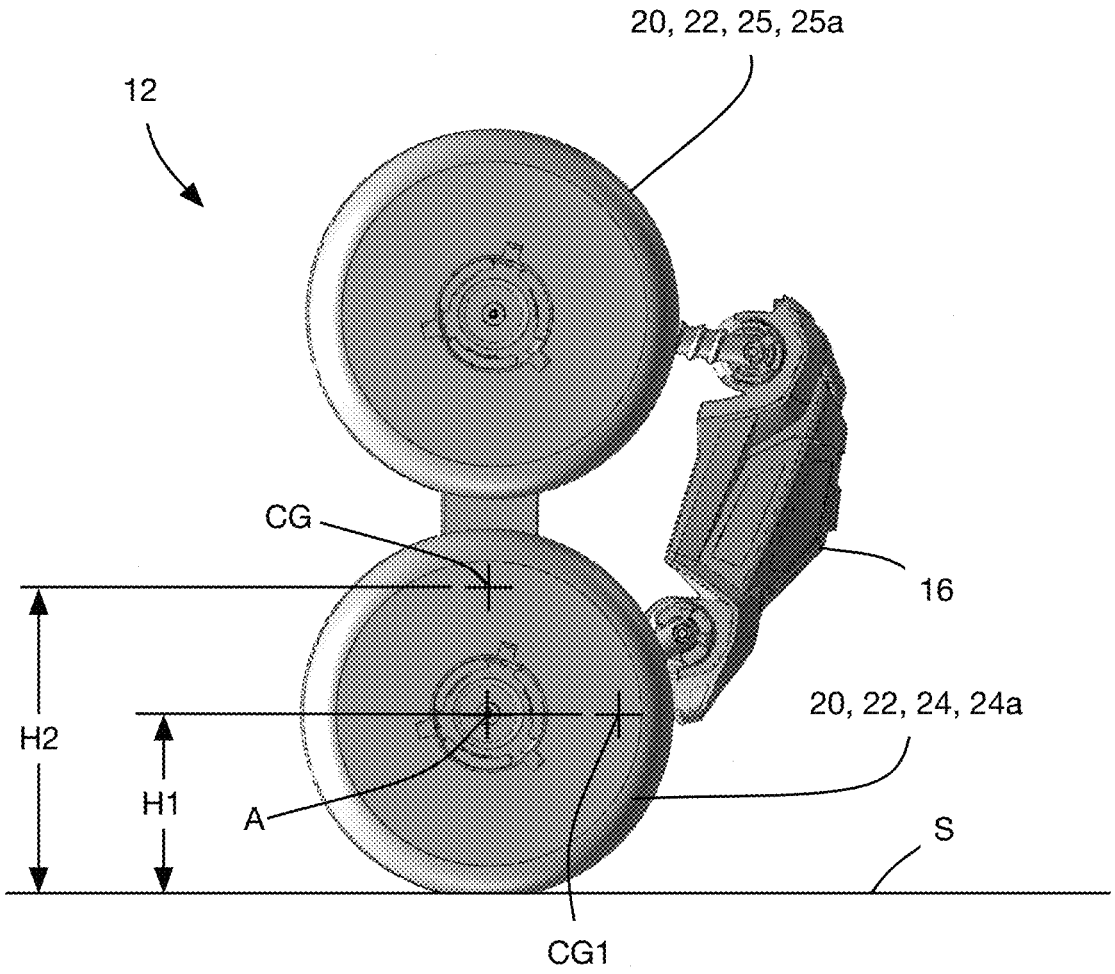
Figure 3D:
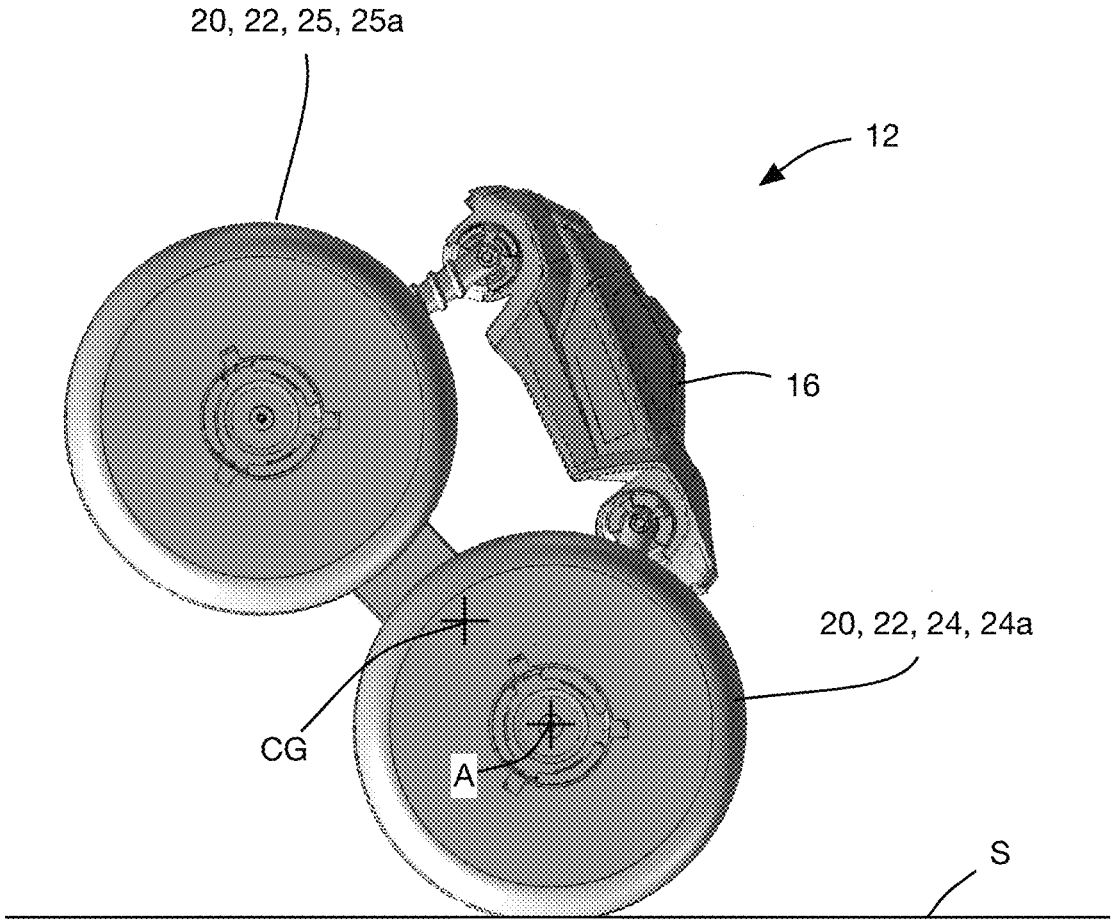

FIGS. 3A-3D illustrate stages in the flipping over of the toy vehicle 12 from the inverted orientation to the upright orientation shown in FIG. 2 when the selected amount of torque is applied by the at least one motor 18 to the at least one driven wheel 22. In the embodiment shown in FIG. 3A, the selected amount of torque drives the at least one flip-over wheel in the forward direction. In FIG. 3B, the reaction torque TR that is exerted on the vehicle body 16, resulting from the selected torque applied by the at least one motor 18, causes the vehicle body 16 to rotate about the axis of rotation A, lifting the vehicle body 16 off of the support surface S. In FIG. 3C, the vehicle body 16 has pivoted to the orientation in which the centre of gravity CG has been elevated to its maximum height. In FIG. 3D, the vehicle body 16 has pivoted past the orientation in FIG. 3C, and would therefore fall to its upright orientation (FIG. 2) even if the at least one motor 18 were powered off.

By contrast, it is possible to have an embodiment in which the toy vehicle 12 sits with its rear wheels touching the support surface S and with its centre of gravity rearwardly positioned such that driving the at least one motor 18 in a backward direction would flip the toy vehicle 12 from the inverted orientation to the upright orientation.

In the embodiment shown in FIG. 2, the position of the centre of gravity CG is selected to provide certain features to the toy vehicle 12. As can be seen in FIGS. 2 and 3A-3D, the at least one flip-over wheel 24 has a radius R, and the centre of gravity CG is spaced from the axis of rotation A by less than the radius R. As a result, it is hypothesized that there is some mechanical advantage provided between the torque applied by the support surface S on the at least one flip-over wheel 24 (so as to resist spinning of the at least one flip-over wheel 24 on the support surface S during application of torque thereto by the at least one motor 18), and the reaction torque that drives the vehicle body 16 to rotate about the axis of rotation A.

In order to position the centre of gravity CG in the selected position, the battery 42 and the at least one motor 18 are positioned closer to the first end 26 than the axis of rotation A is to the first end 26. In the embodiment shown in FIG. 2, this means that the at least one motor 18 and the battery 42 are positioned forward of the axis of rotation A. The battery 42 and the at least one motor 18 are shown schematically in dashed lines in FIG. 2, as they are hidden in this view by other elements of the toy vehicle 12. The at least one motor 18 and the battery 42 constitute relatively dense elements of the toy vehicle 12. By contrast, other elements of the toy vehicle 12 including the entirety of the vehicle body 16, the gear train, and the hubs of the wheels 20 may be made from a lightweight polymeric material (apart from a sparing use of small screws used to assemble elements together where the use of polymeric latch members or other connecting means is not convenient. Furthermore, the wheels themselves may be made from a foamed polymer, so as to maintain low weight and may be fixedly mounted to the hubs of the wheels 20 by any suitable means such as by the use of ribs on the hubs of the wheels 20 that engage slots (not shown) that are provided in the wheels 20, thereby eliminating the need for a strong adhesive to hold the wheels 20 rotationally on the hubs. The hubs of the wheels 20 are shown at 48 in FIG. 1A, while the ribs are shown at 50 and the grooves are shown at 52.

A feature of the toy vehicle 12 is that the balance surface arrangement 29 and the centre of gravity CG may be positioned such that the centre of gravity CG rises by a distance that is less than 25% of the length L of the toy vehicle 12 during application of the selected amount of torque TS by the at least one motor 18 to cause the reaction torque TR in the toy vehicle 12 to drive rotation of the vehicle body 16 over to the upright orientation. It an example, the toy vehicle 12 has a length of approximately 9.5 inches and the centre of gravity rises by about 1.5 inches between the inverted orientation shown in FIG. 3A and the orientation of maximum height of the centre of gravity CG shown in FIG. 3C during flipping over of the toy vehicle 12 to the upright orientation. In FIG. 3C, the height of the centre of gravity (identified as CG1 in FIG. 3C) when the toy vehicle 12 was in the inverted orientation is shown at H1, and the height of the centre of gravity CG when the toy vehicle 12 was in the orientation of maximum height of the centre of gravity CG (i.e. in the position shown in FIG. 3C) is shown at H2. The rise is shown at H. Given the rise H shown in FIG. 3C, it can be seen that in some embodiments, the rise may be less than about 1.5/9.5 or about 16% of the length of the toy vehicle 12. Providing a rise H in the centre of gravity CG that is less than 25% of the length of the toy vehicle 12, and more preferably, a rise H that is less than 16% of the length of the toy vehicle 12, permits the toy vehicle 12 to flip over with a relatively low amount of torque, which in turn permits the at least one motor 18 to be relatively light, thereby reducing the weight of the toy vehicle 12. This, in turn, permits a reduction in the size and weight of the battery 42, which further reduces the weight of the toy vehicle 12 and further improves its performance.

Figure 4:
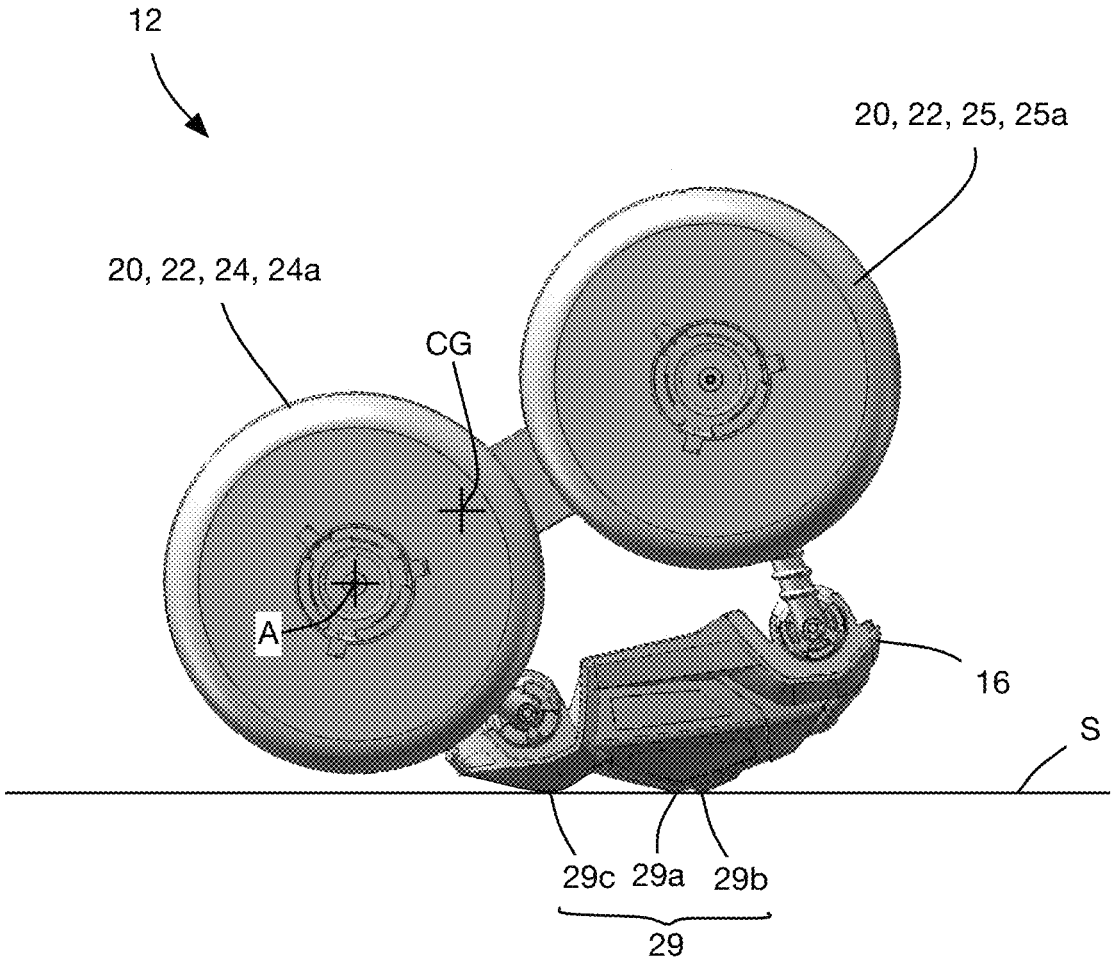
FIG. 4 is a side elevation view of an alternative embodiment of the toy vehicle in which flip-over wheels on the toy vehicle are held above the support surface when the toy vehicle is in the inverted orientation.

Reference is made to FIG. 4, which shows an alternative embodiment of the toy vehicle 12, in which the balance surface arrangement 29 on the vehicle body 16 fully supports the toy vehicle 12 on the support surface S when the toy vehicle 12 is in the inverted orientation as shown in FIG. 4, holding the at least one flip-over wheel 24 spaced from the support surface S. As shown in the example in FIG. 4, the balance surface arrangement includes a first surface portion 29*a*, a second surface portion 29*b* and a third surface portion 29*c*, but may alternatively include more or fewer surface portions. In such an embodiment, the application of the selected torque TS by the at least one motor 18, which results in the reaction torque TR in the vehicle body 16, drives the at least one flip-over wheel 24 into engagement with the support surface S.

In addition to the above, it will be noted that, by positioning the centre of gravity CG towards the front end 26 of the toy vehicle 12, the vehicle 12 can accelerate forwards with less risk of its front wheels lifting off the support surface S, and less risk of the vehicle 12 flipping over backwards to the inverted orientation.

Although specific advantages have been enumerated above, various embodiments may include some, none, or all of the enumerated advantages.

Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. A toy vehicle, comprising:

a vehicle body;

at least one motor that is mounted to the vehicle body, wherein the at least one motor is sized to have a selected amount of torque;

a plurality of wheels rotatably mounted to the vehicle body, wherein the plurality of wheels includes at least one driven wheel that is drivable by the at least one motor, and wherein the at least one driven wheel includes at least one flip-over wheel, wherein the toy vehicle has a first end and a second end, and wherein the at least one flip-over wheel has an axis of rotation that is closer to the first end than to the second end;

wherein the toy vehicle has an upright orientation in which the plurality of wheels support the vehicle body above a support surface, and in which the vehicle body extends above the plurality of wheels, and an inverted orientation in which the vehicle body in part supports the toy vehicle on the support surface and wherein at least one of the at least one driven wheel is engaged with the support surface and in part supports the toy vehicle on the support surface, wherein the toy vehicle has a center of gravity that is positioned, such that, application of the selected amount of torque from the at least one motor to the at least one of the at least one driven wheel while the toy vehicle is in the inverted orientation, causes a reaction torque in the vehicle body to drive rotation of the vehicle body about the axis of rotation from the inverted orientation over to the upright orientation on the support surface, wherein the toy vehicle further includes a battery and wherein the at least one motor and the battery are positioned closer to the first end than the axis of rotation is to the first end, wherein the at least one motor includes a first motor that is forward of the battery, and that directly drives a first motor gear, wherein the first motor gear is engaged with a first gear train that includes a first intermediate gear for the first gear train which is directly engaged with the first motor gear, a first driven wheel gear that is directly connected to a first one of the at least one driven wheel, and is directly with the first intermediate gear for the first gear train, a second driven wheel gear that is directly connected to a second one of the at least one driven wheel, and a plurality of second intermediate gears that extend from the first driven wheel gear to the second driven wheel gear, such that the first motor drives the first motor gear, which in turn drives the first driven wheel gear, which in turn drives the second driven wheel gear, and wherein the at least one motor further includes a second motor that is forward of the battery, and that directly drives a second motor gear, wherein the second motor gear is engaged with a second gear train that includes a first intermediate gear for the second gear train which is directly engaged with the second motor gear, a third driven wheel gear that is directly connected to a third one of the at least one driven wheel, and is directly with the first intermediate gear for the second gear train, a fourth driven wheel gear that is directly connected to a fourth one of the at least one driven wheel, and a plurality of second intermediate gears for the second gear train that extend from the third driven wheel gear to the fourth driven wheel gear, such that the second motor drives the second motor gear, which in turn drives the third driven wheel gear, which in turn drives the fourth driven wheel gear.

2. The toy vehicle as claimed in claim 1, wherein the at least one flip-over wheel has a radius, and wherein the center of gravity is spaced from the axis of rotation by less than the radius.

3. The toy vehicle as claimed in claim 1, wherein the vehicle body includes a balance surface arrangement that at least partially supports the toy vehicle on the support surface when the toy vehicle is in the inverted orientation, wherein the balance surface arrangement and the center of gravity are positioned such that a height of the center of gravity above the support surface rises by a distance that is less than 25% of the length of the toy vehicle during application of the selected amount of torque by the at least one motor to cause the reaction torque in the toy vehicle to drive rotation of the vehicle body over to the upright orientation.

4. The toy vehicle as claimed in claim 1, further comprising a control system in the toy vehicle, that is configured to receive signals from a remote control that is operable remotely from the toy vehicle to control operation of the at least one motor.

5. The toy vehicle as claimed in claim 1, wherein the first end of the toy vehicle is on the at least one flip-over wheel.

6. The toy vehicle as claimed in claim 1, wherein the vehicle body includes a balance surface arrangement that cooperates with the at least one flip-over wheel to support the toy vehicle on the support surface when the toy vehicle is in the inverted orientation.

7. The toy vehicle as claimed in claim 1, wherein the vehicle body includes a balance surface arrangement that fully supports the toy vehicle on the support surface when the toy vehicle is in the inverted orientation, holding the at least one flip-over wheel spaced from the support surface.

* * * * *